US005984712A

United States Patent [19]

Daoud

[11] Patent Number: 5,984,712

[45] Date of Patent: Nov. 16, 1999

[54] BASE MOUNTED STRAIN RELIEF FOR INSULATION DISPLACEMENT CONNECTOR

[75] Inventor: Bassel Hage Daoud, Parsippany, N.J.

[73] Assignee: Lucent Technologies Inc., Murray Hill, N.J.

[21] Appl. No.: 09/103,467

[22] Filed: Jun. 23, 1998

[51] Int. Cl.[6] ..... H01R 4/24

[52] U.S. Cl. ..... 439/417

[58] Field of Search ..... 439/417, 411, 439/412, 409, 404, 395

[56] References Cited

U.S. PATENT DOCUMENTS

| | | | |
|---|---|---|---|
| 4,073,560 | 2/1978 | Anhalt et al. | 439/404 |
| 4,702,544 | 10/1987 | Vachhani et al. | 439/395 |
| 4,913,659 | 4/1990 | Doyle | 439/395 |
| 5,399,099 | 3/1995 | English et al. | 439/417 |
| 5,622,517 | 4/1997 | Heng et al. | 439/417 |

*Primary Examiner*—Michael L. Gellner
*Assistant Examiner*—Antoine Ngandjui

[57] ABSTRACT

A strain relief for an insulation displacement connector contains an IDC with a cap having an entrance aperture and an exit aperture for passage of an electrical conductor and a companion strain relief pedestal located in close proximity to the IDC. The cap is slidably movable between a first position and a second position. The first position facilitates insertion of an electrical conductor through the apertures of the cap and the second position provides strain relief. One side of the pedestal, in cooperation with the IDC, defines a channel. When the cap is moved to the second position, the conductor is guided into the channel and retained at an angular orientation in the channel thereby providing strain relief for the connector.

19 Claims, 10 Drawing Sheets

BASE MOUNTED STRAIN RELIEF FOR INSULATION DISPLACEMENT CONNECTOR

FIELD OF THE INVENTION

This invention relates generally to the field of telephone wire connectors and distribution systems, and specifically to a base mounted strain relief mechanism for an insulation displacement connector (IDC).

BACKGROUND OF INVENTION

Telephone lines, which are carried by electrical conductors known as tip ring wire pairs, are generally aggregated at a particular point in a building prior to being distributed and connected to various types of telephone equipment, such as, for example, telephones, fax machines, modems etc. As the tip ring pairs generally enter the building as part of a multi-conductor cable, the individual tip ring wire pairs must first be broken out from the cable into individual wire pairs. This is normally accomplished in a junction box known as, for example, a building entrance protector (BEP), or network interface unit (NIU). Within such devices the individual telephone line tip ring pairs are separated from the cable, individually connected to a connector block, and made available for further electrical connection and distribution. Usually there is a protector device inserted between the telephone and central office, or network side of the telephone line and the customer equipment or terminal side of the telephone line to protect the telephone and user, or other equipment connected to the telephone line, from hazardous overvoltages induced in the telephone network or in the cables passing between the telephone central office and the building within which the line is terminated.

In a typical arrangement, the telephone lines coming from the network are first wired to a protector field, which is an array of connectors for receiving the protector device, which is in turn hard wired to a first connector block which provides a first test point for testing the telephone line connections between the building and telephone central office. This first terminal block is hard wired to a multi pair connector, most typically a twenty-five pair connector of the RJ21 type, for further connection to an array of customer bridges which are also hard wired and connectorized via a mating RJ21 connector. The use of a customer bridge permits a subscriber to disconnect terminal equipment from a telephone line so that subscriber can isolate troubles on the line as originating in the telephone network, or on the terminal equipment side of the telephone line.

Additionally, there are known insulation displacement connector (IDC) blocks for use in such junction boxes and/or distribution fields, such as the ubiquitous punch down connector block, also known as a 66-type connector block, and the tool-less insulation displacement connector blocks utilizing push cap connectors, such as that described in U.S. Pat. No. 4,913,659 dated Apr. 3, 1990, the entire disclosure of which is incorporated herein by reference. Such a connector block is commercially available under the product designation SC99 from Lucent Technologies Inc.

The tip and ring wires held within such tool-less IDC connectors are strain relieved only to the extent held by the compressive force exerted by the IDC terminal holding the bare wire which has been stripped of its insulation layer. While this prior art IDC works for its intended purpose, a significant drawback to this prior art IDC is that when a pulling force is applied to the tip or ring wire, the wire is easily stripped and disconnected from the terminal. Thus, it is desirable to provide for a better strain relief mechanism for an IDC. Further, when conductors are passed through IDC caps in the prior art IDCs, the free end of the conductor which extends beyond the cap often needs to be cut off. The cut off portion often is very small, easily escaping into equipment or adjacent wire connector fields, increasing the risk of short circuits.

SUMMARY OF THE INVENTION

The present invention is directed at overcoming the shortcomings of the prior art. Generally speaking, in accordance with the present invention, a strain relief mechanism for an IDC comprises a substantially flat base with a first side which includes an IDC and a strain relief pedestal, although typically an array of such IDCs and strain relief pedestals is provided on a common base. The individual IDC has a cap with an entrance aperture and an exit aperture. The cap is slidably movable between a first position and a second position. The first position facilitates the insertion of an electrical conductor, such as a wire, into the cap through the entrance aperture and out of the cap through the exit aperture. The second position provides for electrical and mechanical connection of the wire to the IDC by engagement with the IDC terminal strip within the connector, in a known manner, and, when the inventive teachings herein are utilized, for strain relief for the IDC.

The strain relief pedestal is upstanding from the first side of the base and is disposed in close proximity to the IDC. The pedestal has a wall portion which limits the extension of the electrical conductor beyond the cap upon exit from the exit aperture to a predetermined length. Thus, with the cap in the first position the electrical conductor, upon passing through the cap, is retained on the pedestal in a first orientation. The pedestal may include a central groove which is substantially linearly coextensive with the exit aperture of the cap when the cap is in the first position. In this position, this central groove is capable of guidedly receiving an electrical conductor upon exit from the respective IDC.

The side of the pedestal facing the IDC and the IDC define therebetween a channel.

The channel may substantially extend along the entire height of the pedestal and forms a space that is sized and shaped to permit the receipt of the electrical conductor in the channel when the cap is in the second position, although not so snugly as to introduce undue strain on the conductor as the cap is moved from the first to the second position. That is, when the cap is moved to the second position, the portion of electrical conductor that extends from the cap is forced into the channel and caused to bend and assume an angled orientation relative to that portion of the conductor that is within the IDC cap. Thus, in this second orientation, the conductor is provided with strain relief, as the bending of the conductor, and, if additionally desired, its frictional retention in the channel, increase the force necessary to pull the conductor from the cap.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative, and wherein like reference numerals depict like elements throughout the several views.

DETAILED DESCRIPTION OF THE PREFERRED EMBODIMENTS

Figure 1:
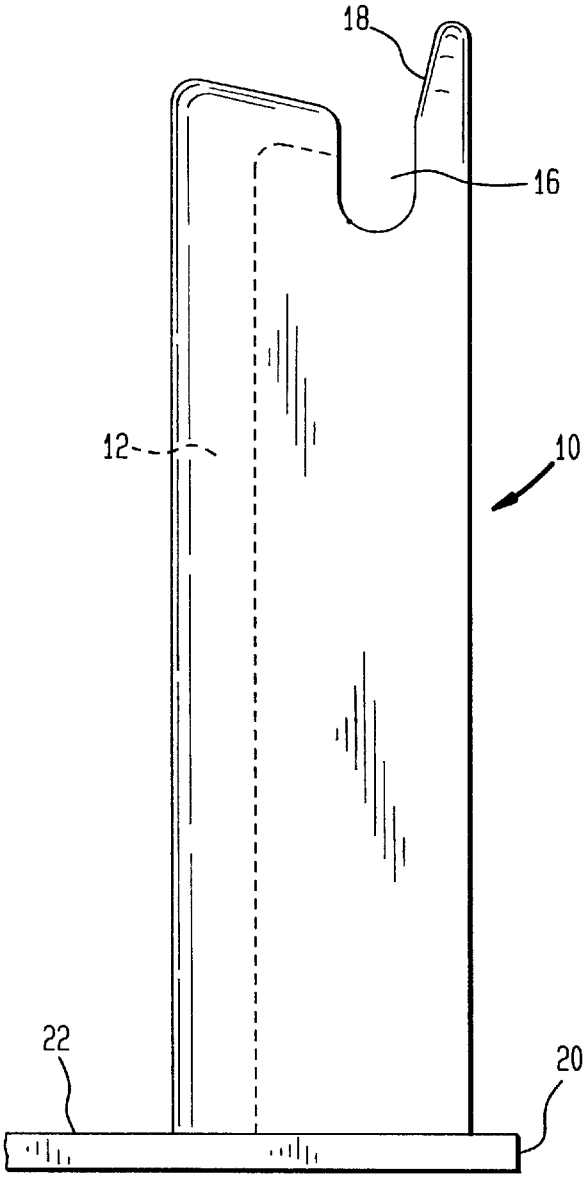
FIG. 1 is a side elevational view of a strain relief pedestal in accordance with the present invention.
Figure 2:
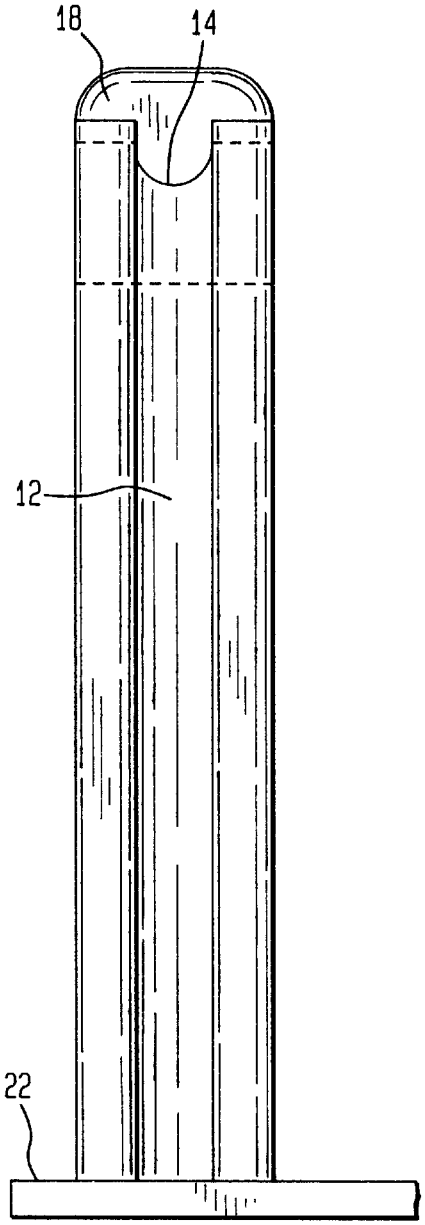
FIG. 2 is a front elevational view of the strain relief pedestal of FIG. 1.
Figure 3:
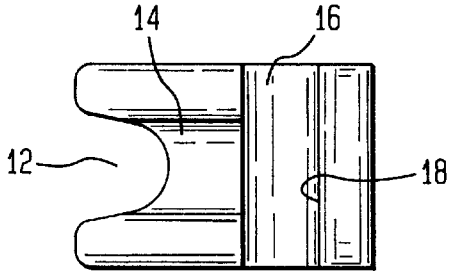
FIG. 3 is a top view of the strain relief pedestal of FIG. 1.

Reference is first made to FIGS. 1–3, which illustrate a strain relief pedestal generally indicated as 10. Strain relief pedestal 10 is upstanding from a first side 22 of a base 20 of a tool-less IDC type connector block. Pedestal 10 includes a stop wall 18 and may also include a central groove 14 and an access channel 16. Central groove 14 and access channel 16 are disposed approximately at right angles to each other. Pedestal 10 also preferably has a trough 12 on a side thereof facing the IDC. The trough 12 preferably, although not necessarily, extends the entire height of pedestal 10. Trough 12 forms a substantially closed space or channel 13 between pedestal 10 and a cap 30 when the pedestal and cap are oriented proximate each other in accordance with the teachings herein, and as further illustrated in FIGS. 4 and 6, discussed below.

Figure 4:
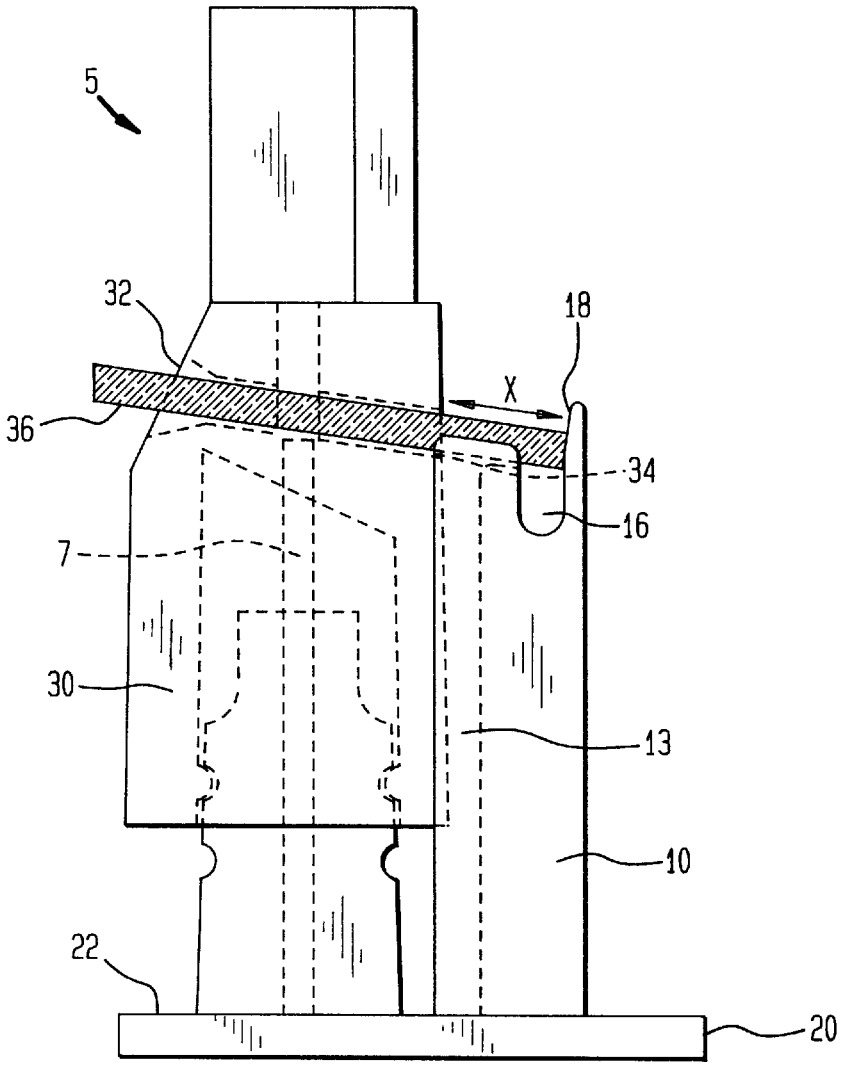
FIG. 4 is a side elevational view of an IDC and a strain relief pedestal with the cap in the first position in accordance with the present invention.
Figure 5:
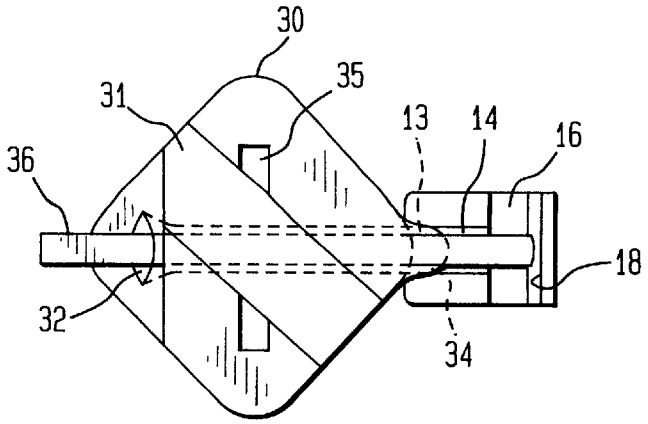
FIG. 5 is a top view of the IDC and a strain relief pedestal of FIG. 4.
Figure 6:
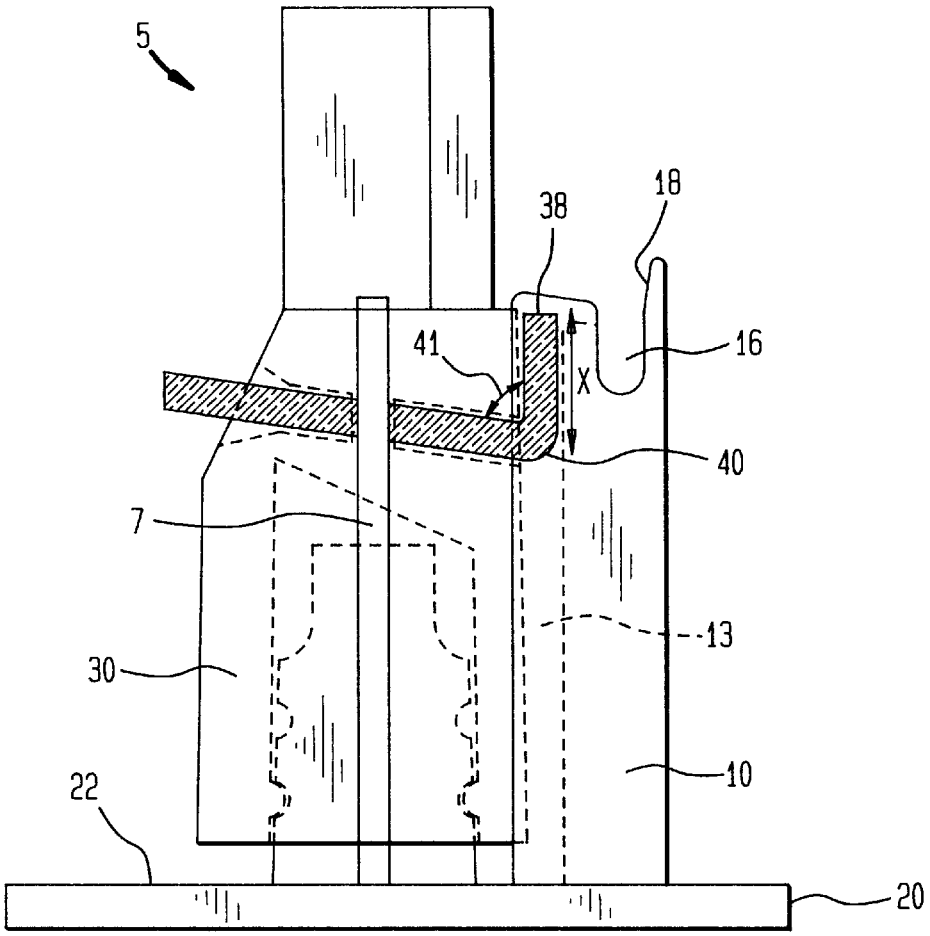
FIG. 6 is a side elevational view of an IDC and a strain relief pedestal with the cap in the second position.
Figure 7:
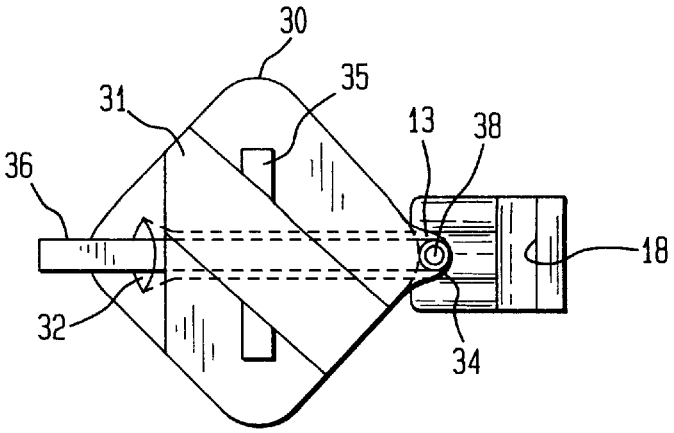
FIG. 7 is a top view of the IDC and a strain relief pedestal of FIG. 6.

FIGS. 4–7 depict an insulation displacement connector (IDC) generally indicated as 5 which is also upstanding from first side 22 of base 20 and in close proximity to pedestal 10. Connector 5 includes cap 30 which has an entrance aperture 32 for receiving a conductor 36, and an exit aperture 34 in fluid communication with entrance aperture 32. Exit aperture 34 is disposed on the side of connector 5 which faces pedestal 10. Cap 30 of connector 5 is slidably movable between a first position and a second position in a manner known in the art. FIGS. 4 and 5 depict cap 30 in the first position whereas FIGS. 6 and 7 depict cap 30 in the second position. Cap 30 may also include a cap grip portion 31 and a test aperture 35. Cap grip portion 31 can be used to easily move cap 30 from the first position to the second position and vice versa. Test aperture 35 may be used for access to a protruding portion of the test ears (not shown) of the IDC terminal strip contained within the cap, in a manner known in the art. These test ears can be used to test the connection of the electrical conductor at the IDC.

In use, an electrical conductor 36 is generally passed through cap 30 by inserting it into entrance aperture 32 and causing it to exit the cap through exit aperture 34. When cap 30 is in the first position, as shown in FIGS. 4–5, exit aperture 34 is substantially linearly co-extensive with central groove 14 of pedestal 10. Thus, electrical conductor 36 passing through entrance aperture 32 and exit aperture 34 can be guidedly received by central groove 14. Electrical conductor 36 can travel down central groove 14 until it abuts a stop wall 18. When so inserted, conductor 36 is retained in central groove 14 at a first orientation as illustrated in FIG. 4, and extends beyond exit aperture 34 for a predetermined length X. A portion of the outer surface of cap 30 in cooperation with trough 12 forms therebetween an elongated, tunnel-like channel 13. Channel 13 preferably extends along the height of pedestal 10 and has a diameter that is sized and shaped so that it can readily receive and snugly retain electrical conductor 36 therein.

Reference is now made to FIGS. 6–7 which depict cap 30 of connector 5 in a second position. This second position is achieved by pushing cap 30 in a downward direction toward first side 22 of base 20. Cap 30 may be gripped at cap grip portion 31 to facilitate the movement of cap 30. When cap 30 is pushed down into a second position, electrical conductor 36 is driven into contact with terminal strip 7 whereupon it is stripped of insulation and mechanically and electrically coupled to terminal strip 7 within connector 5 in a manner known in the art. Also, while passing from the first to the second position, electrical conductor 36 is bent at conductor first bend 40 as a result of its engagement with pedestal 10 along groove 14, as shown in FIG. 6. Once in the second position, predetermined length X of electrical conductor 36 is contained within channel 13 at a second orientation which is at an angle 41 to the length of conductor 36 remaining and extending within cap 30, which remains substantially in the first orientation discussed above, as illustrated in FIG. 6.

The end of predetermined length X which abutted against stop wall 18 when cap 30 was in the first position is now exposed at conductor open end 38 (FIG. 7) with cap 30 in the second position. Thus, with cap 30 in the second position conductor open end 38 can be used as an additional testing point in addition to, or as a substitute for the prior art test ears accessible through test apertures 35. Conductor open end 38 permits an installer, repair person or other user requiring testing ability to perform electrical tests on specific telephone lines without the need to disassemble connector 5. This greatly simplifies testing and assists in the localization of problems.

In the second position of cap 30, predetermined length X of electrical conductor 36 is firmly contained in channel 13 and, therefore, provides strong resistance to any pulling force that may be applied on electrical conductor 36. Resistance to any pulling force on conductor 36 is provided by length X of conductor 36 contained in channel 13 and not by the compressive force exerted by the IDC terminal on conductor 36. Conductor first bend 40 fields the brunt of any pulling force that may be applied to conductor 36. Consequently, the conductor portion retained within the terminal strip is relieved from any strain which may result from the application of a pulling force on the conductor. Thus, this mechanism provides for strong strain relief for connector 5. Connector 5 along with cap 30 are preferably designed in such a manner such that electrical conductor 36 will break before it is released at conductor first bend 40 and slides out of exit aperture 34 and entrance aperture 32. This provides for an efficient strain relief mechanism for insulation displacement connector 5. In a preferred embodiment, conductor bend angle 41 of electrical conductor 36 is approximately equal to or less than 90°, although the person of skill will recognize that the precise angle 41, the length of extension X of conductor 36, as well as the dimensions of the pedestal 10 and channel 13, are a matter of conductor size and other application specific design requirements, and are thus readily adaptable by the person of skill utilizing the teachings herein. Thus, for example, the bend angle may be, for example, about 90° to about 150°. Additionally, the channel 13 may be sized to provide additional retention of the conductor through frictional engagement of the conductor and the interior surface of the channel, provided that the friction introduced is not unduly high, so as to avoid the introduction of strain on the conductor as the cap is moved from the first to the second position.

Figure 8:
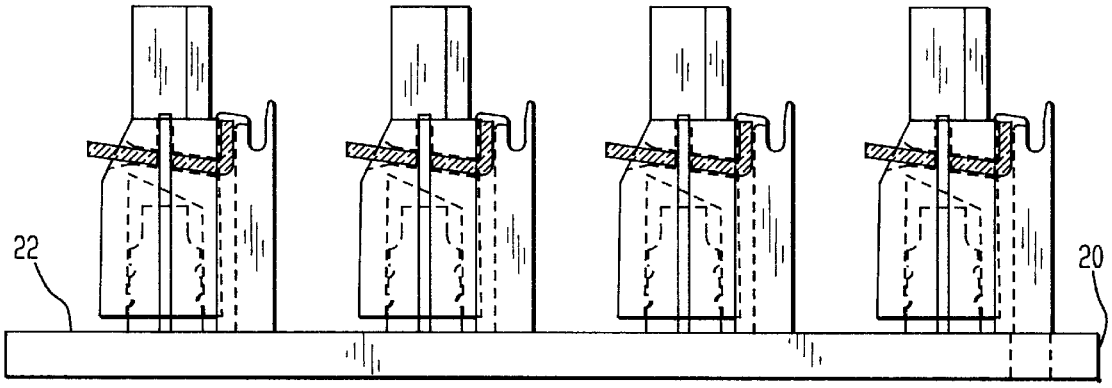
FIG. 8 is a side elevational view of an array of insulation displacement connectors and respective strain relief pedestals on a connector block with the caps in the second position.
Figure 9:
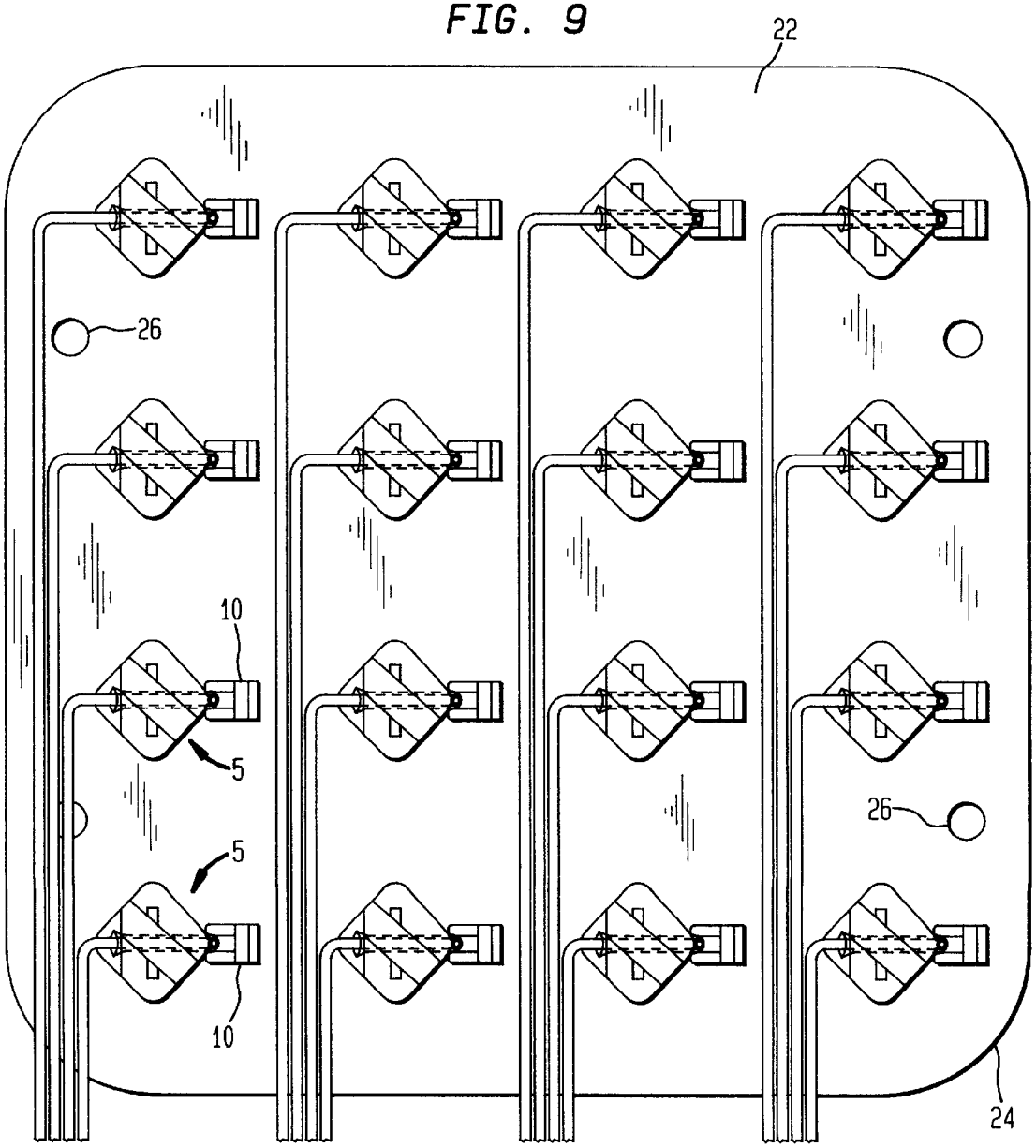
FIG. 9 is a top view of the array of insulation displacement connectors and respective strain relief pedestals of FIG. 8.
Figure 10:
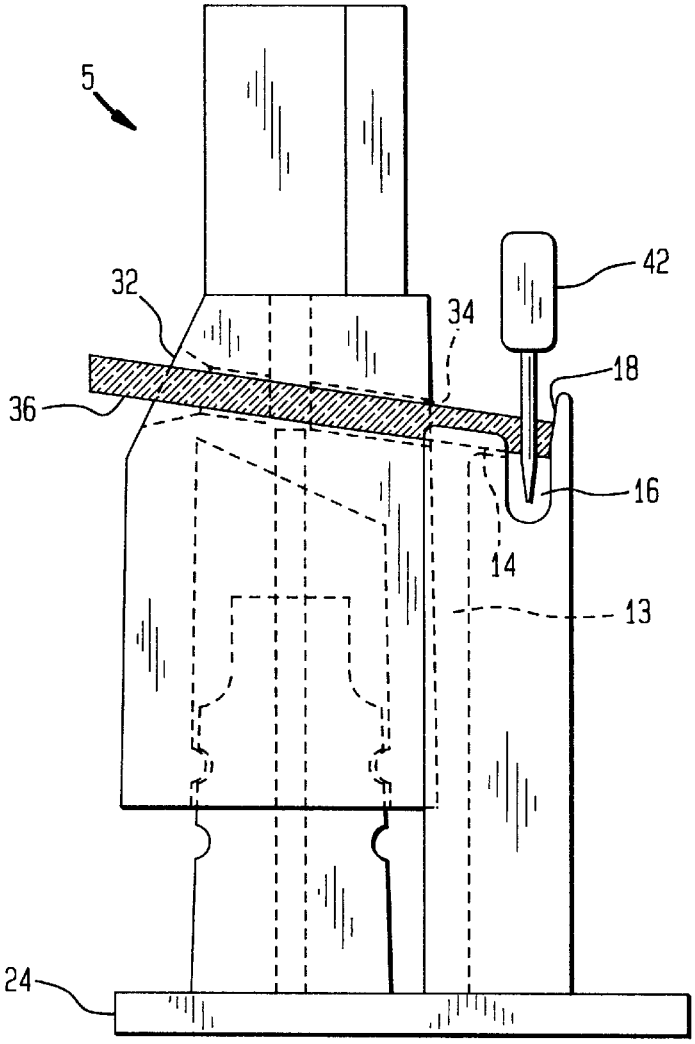
FIG. 10 is side elevational view of an IDC and a strain relief pedestal with the cap in the first position showing an adjusting object.
Figure 11:
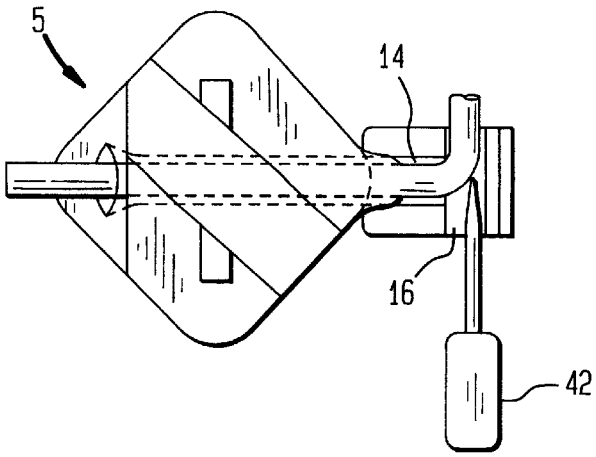
FIG. 11 is a top view of an IDC and a strain relief pedestal with the cap in the first position showing how an adjusting object can be used to feed the electrical conductor to another IDC.
Figure 12:
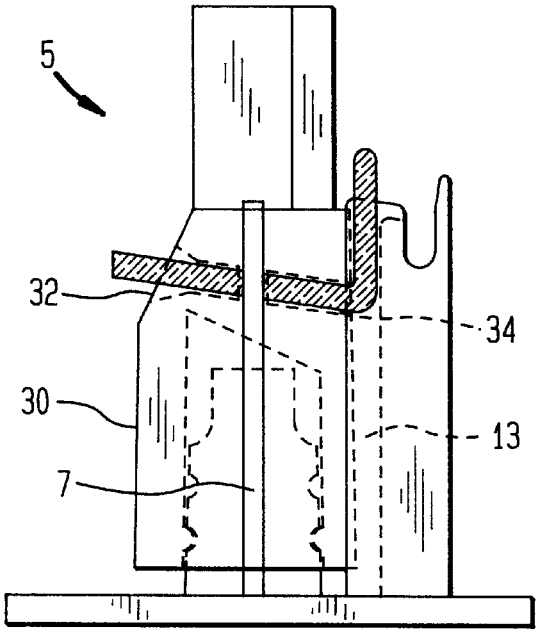
FIG. 12 is a side elevational view of an IDC and a strain relief pedestal with the cap in the second position.

Reference is now made to FIGS. 8–9 which further depict an exemplary embodiment of the present invention. FIGS. 8 and 9 show an array of insulation displacement connectors 5 and their respective strain relief pedestals 10 contained on a connector block 24. Clearly, in a preferred embodiment, a plurality of connectors 5 and pedestals 10 may be contained on connector block 24 in varying combinations. FIGS. 8 and 9 merely depict one set of myriad combinations wherein connector block 24 has a four-by-four array of connectors 5 and strain relief pedestals 10. Connector block 24 is also typically provided with mounting holes 26 to facilitate mounting of connector block 24 via screwing or riveting. The precise method of securing connector block 24 to a surface is a matter of design choice within the skill of the routineer in the art, and may be achieved via screwing, riveting, adhesion, snap fitting, or any other recognized method of achieving a firm mechanical connection between the block and the structure to which it will be mounted.

As illustrated in FIGS. 10–13, electrical conductor 36 may be connected to a plurality of connectors 5 to facilitate the appearance of the same telephone line pair on multiple pairs of connectors 5 of connector block 24. In this embodiment, electrical conductor 36 is fed through entrance aperture 32 and out through exit aperture 34 of a first connector 5. With the cap in the first position, electrical conductor 36 travels down central groove 14 until it abuts stop wall 18. At this point, instead of pushing cap 30 into the second position, the end of electrical conductor 36 abutting stop wall 18 is pushed up or sideways and out of engagement with stop wall 18 with the help of an adjusting object 42 so that it can be further drawn and fed to a second connector 5'. Adjusting object 42 enters access channel 16 to facilitate lifting of electrical conductor 36 out of central groove 14. By way of non-limiting example, adjusting object 42 may be a screwdriver, pen, pencil, a user's finger, awl, probe or other elongated object. After electrical conductor 36 has been pushed up with adjusting object 42, electrical conductor 36 is fed into the entrance aperture 32' of second conductor 5' and out through exit aperture 34' of second conductor 5'. Electrical conductor 36 then travels through central groove 14' of second conductor 5' till it abuts stop wall 18' of second conductor 5'. Electrical conductor 36 can be further extended and passed through a plurality of connectors 5 in the same manner. Such an implementation facilitates the connection of multiple connectors 5 to a single electrical conductor 36.

Figure 13:
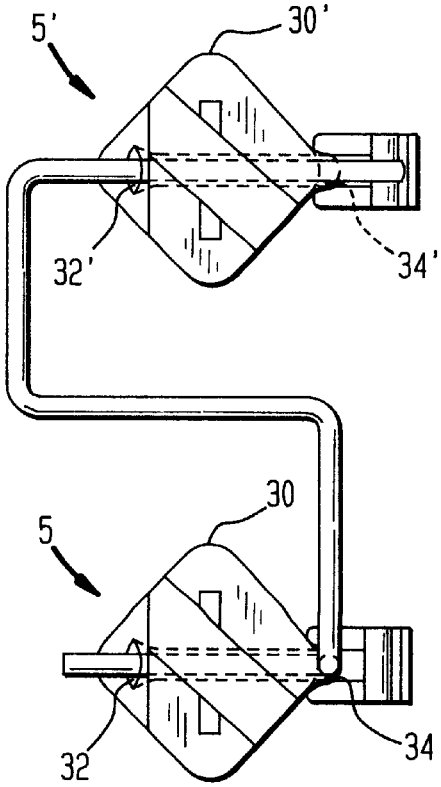
FIG. 13 is a top view of two insulation displacement connectors and their respective strain relief pedestals with the caps in the second position showing the electrical conductor being fed from a first IDC to a second IDC.

By threading a single conductor 36 into and out of multiple connectors 5, numerous connections or "taps" may be made to a single telephone line terminated on connector block 24. In FIG. 13, when caps 30 and 30' are pushed down into the second position, electrical conductor 36 is firmly contained within channels 13 and 13' thereby providing strong strain relief for connectors 5 and 5'. The conductor open end 38 of electrical conductor 36 located on the last connector 5 in the series is still available as an alternative testing point. For an efficient allocation of electrical conductor 36 and to prevent either undue stretching or overly loose connections of electrical conductor 36, caps 30 may be pushed into the second position beginning with the last connector 5 to which electrical conductor 36 is connected.

Figure 14:
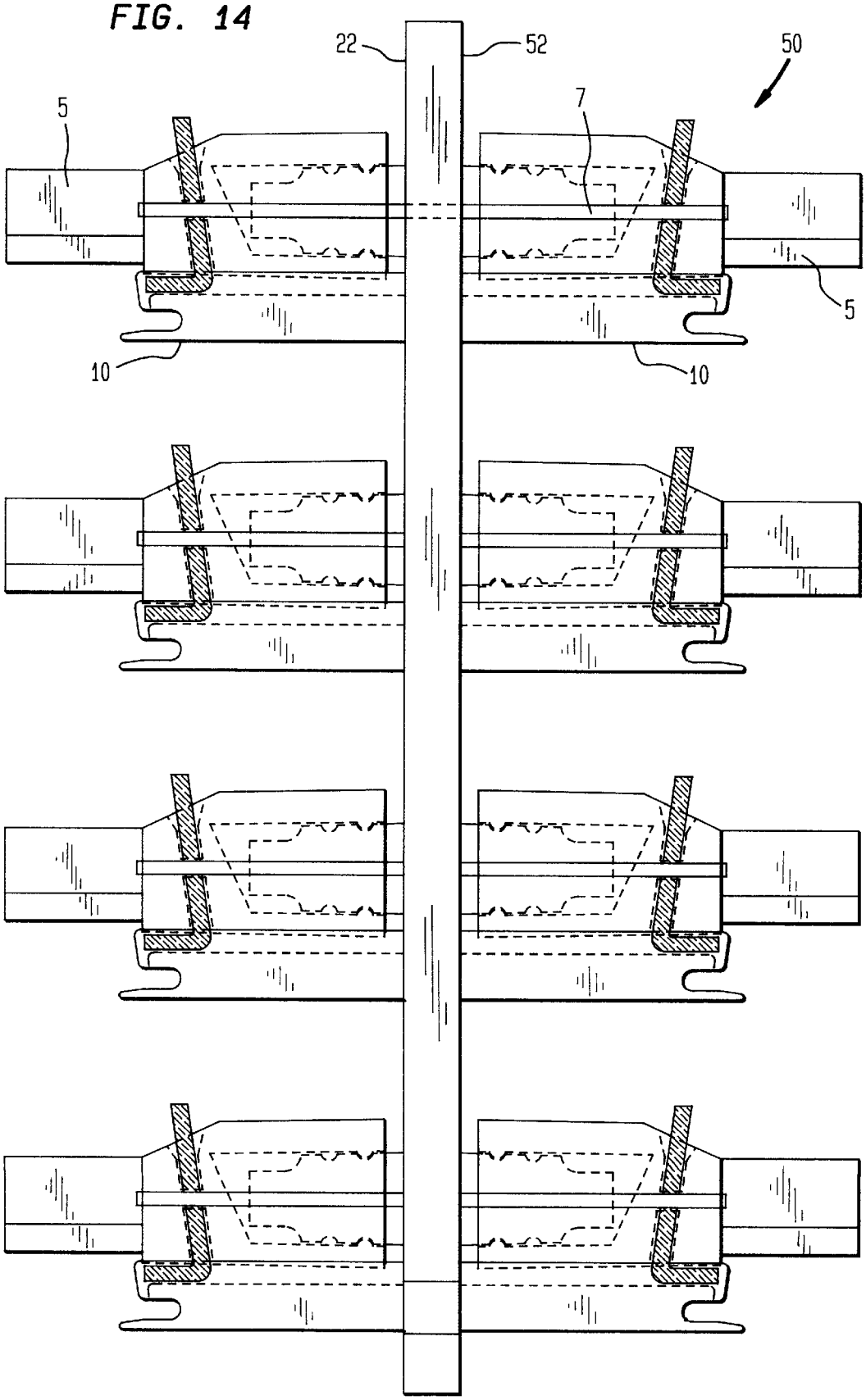
FIG. 14 is a side elevational view of an alternate embodiment of an array of insulation displacement connectors and respective strain relief pedestals for use in a double sided strain relieved IDC connector block.
Figure 15:
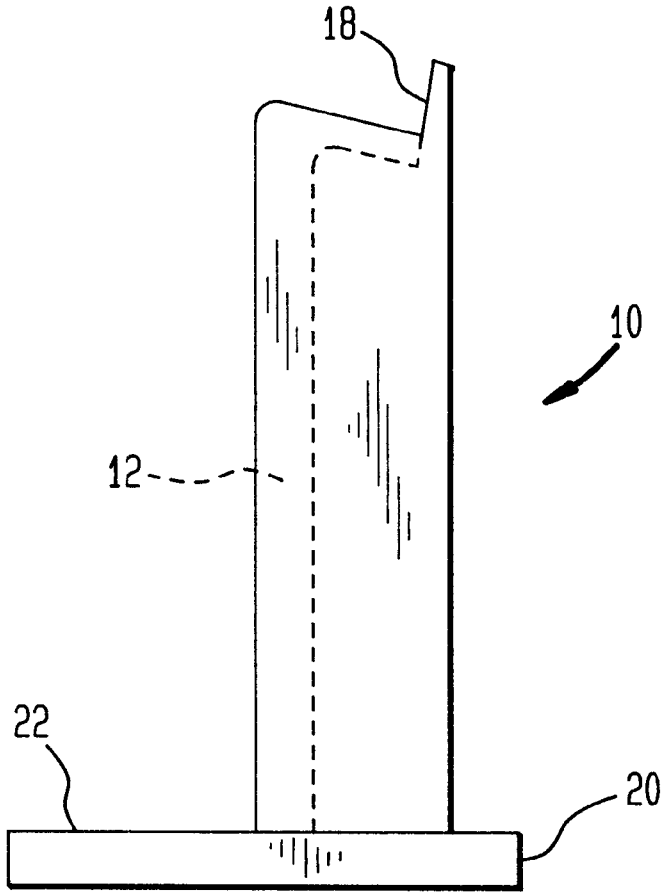
FIG. 15 is a side elevational view of an alternate embodiment of a strain relief pedestal in accordance with the present invention.
Figure 16:
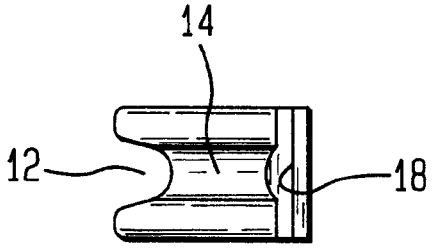
FIG. 16 is a top view of the strain relief pedestal of FIG. 15.

Reference is now made to FIG. 14, which illustrates another exemplary embodiment of a strain relieved insulation displacement connector 5 in accordance with the present invention. FIG. 14 depicts a dual-sided connector block 50 which has connectors 5 and pedestals 10 on each side of base 20. Thus, in addition to having connectors 5 and pedestals 10 on first side 22, dual-sided connector block 50 also has connectors 5 and pedestals 10 on a second side 52. Terminal strip 7 may, if desired, extend through base 20 to form an electrical connection between the connectors on opposite respective sides of block 50.

Figure 17:
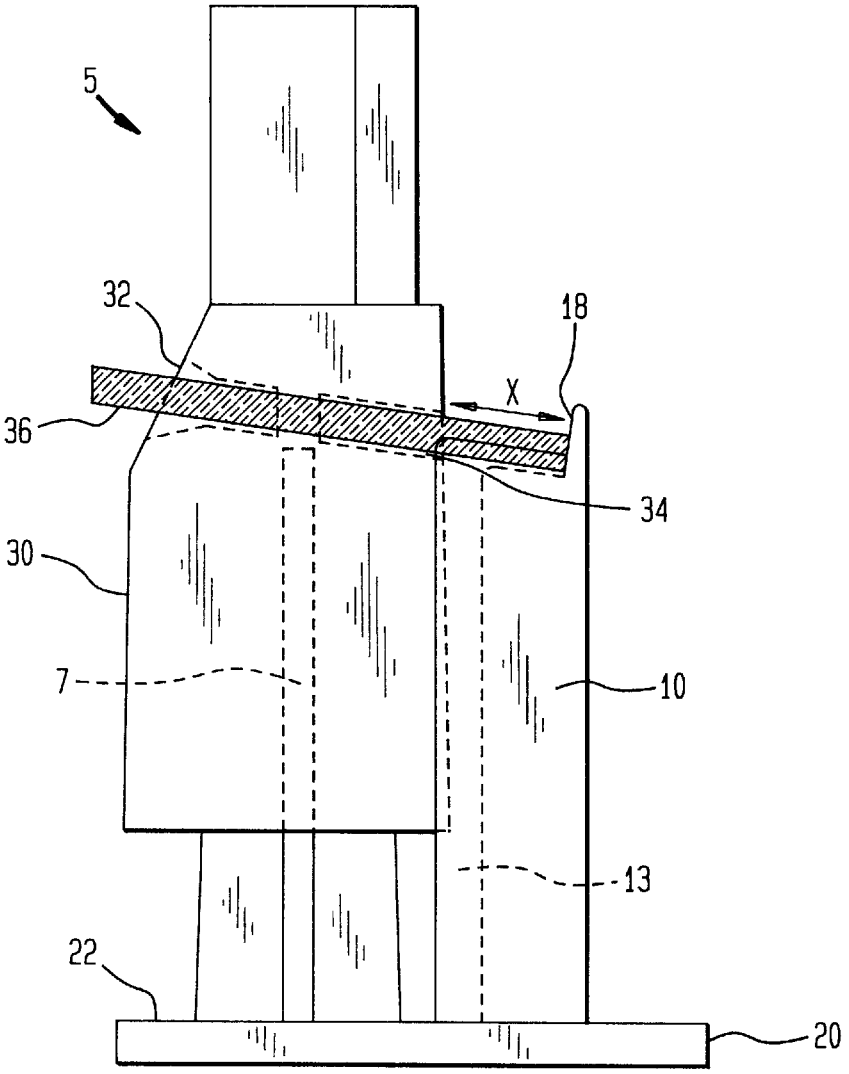
FIG. 17 is a side elevational view of an alternate embodiment of an IDC and a strain relief pedestal with the cap in the first position in accordance with the present invention.
Figure 18:
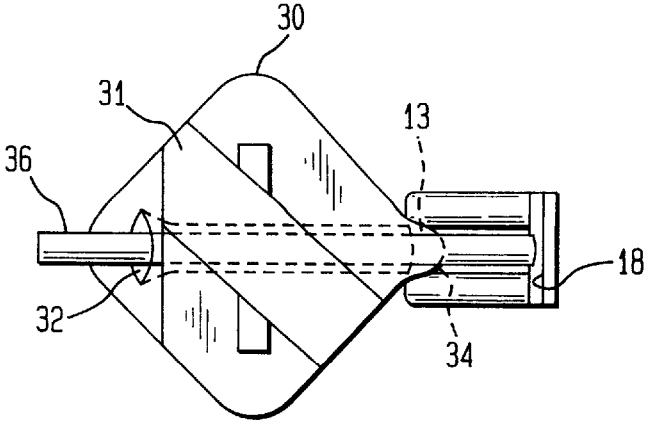
FIG. 18 is a top elevational view of the IDC and strain relief pedestal of FIG. 17.
Figure 19:
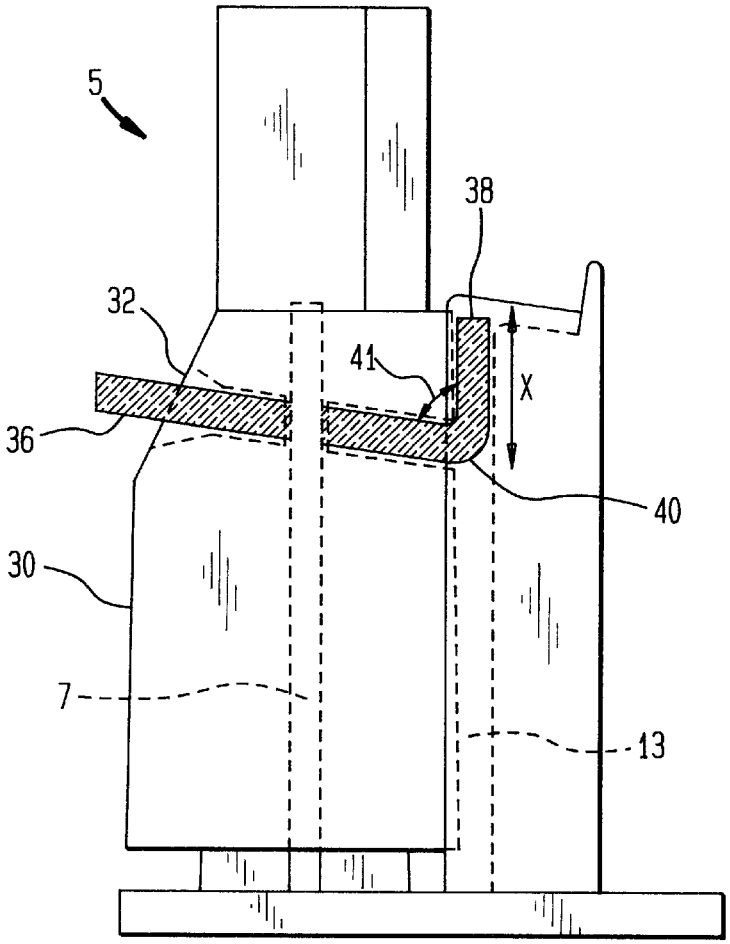
FIG. 19 is a side elevational view of the IDC and strain relief pedestal of FIG. 17 with the cap in the second position.
Figure 20:
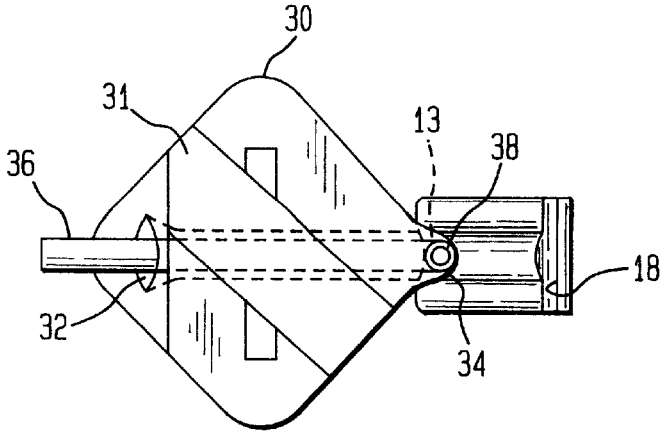
FIG. 20 is a top elevational view of the IDC and strain relief pedestal of FIG. 17 with the cap in the second position.

Reference is now made to FIGS. 15–20 which illustrate another embodiment of strain relief pedestal 10 constructed in accordance with the present invention. This embodiment does not contain access channel 16 and, thus, is ideally suited for use in a non pass-through mode wherein each electrical conductor 36 is only connected to a corresponding single connector 5. FIGS. 17 and 18 depict cap 30 in the first position whereas FIGS. 19 and 20 depict cap 30 in the second position, as described above.

When cap 30 is in the first position, exit aperture 34 is substantially linearly coextensive with central groove 14 of pedestal 10. Electrical conductor 36 passes through entrance aperture 32 and out through exit aperture 34 and is guidedly received by central groove 14. Conductor 36 travels down central groove 14 until it abuts with stop wall 18.

Thus, conductor 36 is retained in central groove 14 at a first orientation as illustrated in FIGS. 17 and 18. Conductor 36 extends beyond exit aperture 34 for a predetermined length X. Subsequently, when cap 38 is pushed into the second position, electrical conductor 36 is bent at conductor first bend 40 as shown in FIGS. 19 and 20. In this second position, predetermined length X of electrical conductor 36 is contained within channel 13 at a second orientation which is at an angle 41 to the length of conductor 36 extending within cap 30, which remains substantially in the first orientation discussed above, as illustrated in FIGS. 17 and 18. The end of predetermined length X which abutted against stop wall 18 when cap 30 was in the first position is now exposed at conductor open end 38 with cap 30 in the second position. Conductor open end 38 can be used as an additional testing point as discussed above.

With cap 30 in the second position, predetermined length X of electrical conductor 36 is formally contained in channel 13 and, therefore, provides strong resistance to any pulling force that may be applied on electrical conductor 36. Resistance to any pulling force on conductor 36 is provided by length X of conductor 36 contained in channel 13 and not by the compressive force exerted by the IDC terminal 7 on the portion of conductor 36 gripped thereby. Conductor first bend 41 fields the brunt of any pulling force that may be applied to conductor 36. Consequently, the terminal strip is relieved from strain.

The base, pedestal and cap may be formed of any art recognized material having the proper insulating and mechanical properties. Preferably, a plastic is employed. Further, pedestal 10 may be integrally formed on base 20, or may be a separate part that is fixedly attached to base 20, as by screwing, gluing or the like, or may be selectively removeably attachable to base 20, as by snap fitting, compression fitting screwing or the like. In this manner, a connector array can be customized to have some or all connectors strain relieved, as a matter of application specific design choice. It will also be recognized that the pedestal 10 may be configured without stop wall 18, thereby permitting pedestal 10 to be positioned adjacent either entrance aperture 32 or exit aperture 34.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A strain relief for a conductor retained in an insulation displacement connector, comprising:

a substantially flat base having a first side;

an insulation displacement connector on said first side, said insulation displacement connector including a cap having therein an entrance aperture in fluid communication with an exit aperture for passage therethrough in a first direction of an electrical conductor, said cap being slidably movable between a first position for facilitating insertion of said electrical conductor into said cap through said entrance aperture and for passage out through said exit aperture, and a second position;

a strain relief pedestal upstanding from said first side in close proximity to said insulation displacement connector, said pedestal having a stop wall, said pedestal being disposed relative to said connector such that passage of said electrical conductor from said exit aperture is limited to a predetermined length by abutment with said stop wall and retained on said pedestal at a first orientation substantially parallel to said first direction;

said pedestal and said cap defining therebetween a channel having a diameter so sized and shaped as to permit receipt therein of said electrical conductor; and said electrical conductor being guided into said channel when said cap is moved into said second position so as to cause said length of electrical conductor to be oriented in said channel at a conductor bend angle in a second orientation for strain relieving said conductor.

2. The strain relief of claim 1, wherein said cap includes a cap grip portion for facilitating movement of said cap from said first position to said second position and vice versa.

3. The strain relief of claim 1, wherein said cap includes a test aperture for facilitating the testing of said electrical conductor.

4. The strain relief of claim 1, said electrical conductor including a conductor open end, said conductor open end being exposed when said cap is in said second position and providing a testing point to facilitate the testing of said electrical conductor.

5. The strain relief of claim 1, wherein said conductor bend angle is approximately equal to 90°.

6. The strain relief of claim 1, wherein said conductor bend angle is less than 90°.

7. The strain relief of claim 1, wherein said pedestal is selectably removeably attachable to said base.

8. The strain relief of claim 1, wherein said channel is so sized and shaped as to introduce an amount of friction between said conductor and a portion of said channel for providing additional strain relief.

9. The strain relief of claim 1, wherein said pedestal further comprises a central groove which is substantially linearly coextensive with said exit aperture when said cap is in said first position, said central groove being capable of guidedly receiving said electrical conductor upon exit from said exit aperture, said stop wall being disposed at an angle to said central groove.

10. The strain relief of claim 9, wherein said pedestal includes an access channel for facilitating entry of an adjusting object to lift said electrical conductor out of said central groove.

11. A strain relieved insulation displacement connector block comprising:

a substantially flat base having a first side;

a first array of insulation displacement connectors on said first side, each of said insulation displacement connectors including a cap having therein an entrance aperture in fluid communication with an exit aperture for passage therethrough in a first direction of an electrical conductor, said cap being slidably movable between a first position for facilitating insertion of said electrical conductor into said cap through said entrance aperture and for passage out through said exit aperture, and a second position;

a companion array of strain relief pedestals upstanding from said first side, each in close proximity to a respective one insulation displacement connector of said connector array, each of said pedestals having a stop wall, each said pedestal being disposed such that passage of said electrical conductor from said exit aperture of said respective connector is limited to a predetermined length by abutment with said stop wall; and retained on said pedestal at a first orientation substantially parallel to said first direction;

each said pedestal and each respective cap of said respective connector defining therebetween a channel having a diameter so sized and shaped as to permit receipt therein of said electrical conductor;

said electrical conductor being guided into said channel when said cap is moved into said second position so as to cause, said length of electrical conductor to be oriented in said channel at a conductor bend angle in a second orientation for strain relieving said conductor.

12. A dual sided strain relieved insulation displacement connector block comprising:

a substantially flat base having a first side and a second side opposite said first side;

a first array of insulation displacement connectors on said first side;

a second array of insulation displacement connectors on said second side, each of said insulation displacement connectors in said first array and said second array including a cap having therein an entrance aperture in fluid communication with an exit aperture for passage therethrough in a first direction of an electrical conductor, said cap being slidably movable between a first position for facilitating insertion of said electrical conductor into said cap through said entrance aperture and for passage out through said exit aperture, and a second position;

a companion array of strain relief pedestals upstanding from said first side and said second side in close proximity to a respective insulation displacement connector, each of said pedestals having a stop wall, each said pedestal being disposed such that passage of said electrical conductor from said exit aperture of said respective connector is limited to a predetermined length by abutment with said stop wall and retained on said pedestal at a first orientation substantially parallel to said first direction;

each said pedestal and each respective cap of said respective connector defining therebetween a channel having a diameter so sized and shaped as to permit receipt therein of said electrical conductor;

said electrical conductor being guided into said channel when said cap is moved into said second position so as to cause said length of electrical conductor to be oriented in said channel at a conductor bend angle in a second orientation for relieving said conductor.

13. A strain relief for an insulation displacement connector having a morable cap, the strain relief comprising a pedestal in proximity to said connector and defining therebetween a channel for receiving a portion of an electrical conductor extending through an exit aperture and beyond said cap, said pedestal having a surface which contacts said conductor portion as said cap is moved from a first position to a second position for causing said conductor portion to become predeterminately oriented within said channel when said cap is in said second position, said predetermined orientation resulting in said conductor being strain relieved.

14. The strain relief of claim 13, wherein said predetermined orientation is at a predetermined angle to a second portion of said conductor oriented within said cap.

15. The strain relief of claim 13, further comprising a stop wall positioned on said pedestal for limiting said conductor portion to a predetermined length.

16. The strain relief of claim 13, wherein said pedestal is selectably removeably positionable proximate said connector.

17. The strain relief of claim 13, wherein said channel is so sized and shaped as to introduce a predetermined amount of friction between said conductor portion and a portion of said channel.

18. The strain relief of claim 13, further comprising a groove formed in said contact surface for guidedly receiving said conductor portion.

19. The strain relief of claim 18, wherein said pedestal has a second groove formed in a surface adjacent said cap, a portion of said groove and a portion of said cap defining therebetween said channel.

* * * * *